US011149356B2

(12) United States Patent
Baek et al.

(10) Patent No.: US 11,149,356 B2
(45) Date of Patent: Oct. 19, 2021

(54) METHODS OF FORMING METALS USING IONIC LIQUIDS

(71) Applicant: Battelle Energy Alliance, LLC, Idaho Falls, ID (US)

(72) Inventors: Donna L. Baek, Idaho Falls, ID (US); Robert V. Fox, Idaho Falls, ID (US); Tedd E. Lister, Lewisville, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 530 days.

(21) Appl. No.: 15/847,757

(22) Filed: Dec. 19, 2017

(65) Prior Publication Data

US 2019/0186031 A1 Jun. 20, 2019

(51) Int. Cl.

| | |
|---|---|
| ***C25C 3/00*** | (2006.01) |
| ***C25C 3/34*** | (2006.01) |
| ***C25C 7/06*** | (2006.01) |

(52) U.S. Cl.
CPC . *C25C 3/34* (2013.01); *C25C 7/06* (2013.01)

(58) Field of Classification Search
CPC .... C25C 3/00; C25C 7/00; C25C 1/00; C25C 7/007; C25C 7/02
USPC ..... 205/368
See application file for complete search history.

(56) References Cited

U.S. PATENT DOCUMENTS

| | | | | |
|---|---|---|---|---|
| 2,431,723 | A * | 12/1947 | Yerkes | C25C 3/00 205/366 |
| 4,620,897 | A | 11/1986 | Nakajima | |
| 4,649,031 | A | 3/1987 | Matyas et al. | |
| 5,021,224 | A | 6/1991 | Nakajima | |
| 5,190,625 | A | 3/1993 | Seon et al. | |
| 6,365,301 | B1 | 4/2002 | Michot et al. | |
| 9,184,478 | B2 | 11/2015 | Friesen et al. | |
| 9,394,586 | B2 | 7/2016 | Joshi et al. | |
| 9,580,772 | B2 | 2/2017 | Rodopoulos et al. | |
| 2003/0121799 | A1 | 7/2003 | Stevens et al. | |
| 2004/0199015 | A1 | 10/2004 | Yuyama et al. | |
| 2010/0247808 | A1 | 9/2010 | Hinc et al. | |

(Continued)

FOREIGN PATENT DOCUMENTS

| | | | |
|---|---|---|---|
| AU | 2010233484 | B2 | 1/2016 |
| CN | 1176238 | A | 3/1998 |

(Continued)

OTHER PUBLICATIONS

Baba et al., "Recent advances in extraction and separation of rare-earth metal using ionic liquids", Journal of Chemical Engineering of Japan, vol. 44, No. 10, (2011) pp. 679-685.

(Continued)

*Primary Examiner* — Zulmariam Mendez
(74) *Attorney, Agent, or Firm* — TraskBritt

(57) ABSTRACT

A method of forming an elemental metal (e.g., a rare-earth element) includes forming a multicomponent solution comprising an ionic liquid, a secondary component, and a metal-containing compound. The multicomponent solution is contacted with at least a first electrode and a second electrode. A current is passed between the first electrode to the second electrode through the multicomponent solution. The metal-containing compound is reduced to deposit the elemental metal therefrom on the first electrode.

30 Claims, 8 Drawing Sheets

(56) References Cited

U.S. PATENT DOCUMENTS

| | | | | |
|---|---|---|---|---|
| 2012/0000790 | A1* | 1/2012 | Rodopoulos | C25C 3/00 205/560 |
| 2013/0233716 | A1* | 9/2013 | Hatchett | C25C 3/34 205/44 |
| 2014/0024173 | A1 | 1/2014 | Xiao et al. | |
| 2014/0057153 | A1 | 2/2014 | Visco et al. | |
| 2014/0099249 | A1 | 4/2014 | Massonne et al. | |
| 2014/0342249 | A1 | 11/2014 | He et al. | |
| 2014/0374267 | A1 | 12/2014 | Monteiro et al. | |
| 2015/0047465 | A1 | 2/2015 | Langley | |
| 2015/0143954 | A1 | 5/2015 | Neumann et al. | |
| 2015/0283377 | A1 | 10/2015 | Ingman et al. | |
| 2016/0083860 | A1 | 3/2016 | Monteiro et al. | |
| 2016/0222532 | A1 | 8/2016 | Sutto | |

FOREIGN PATENT DOCUMENTS

| | | | |
|---|---|---|---|
| CN | 101880153 | A | 11/2010 |
| CN | 104195336 | A | 12/2014 |
| EP | 1702374 | B1 | 11/2015 |
| RU | 2170775 | C1 | 7/2001 |
| RU | 2293134 | C1 | 2/2007 |
| RU | 2435050 | C2 | 11/2011 |
| WO | 8706254 | A1 | 10/1987 |
| WO | 1987006254 | A1 | 10/1987 |
| WO | 2014159098 | A1 | 10/2014 |
| WO | 2015106324 | A1 | 7/2015 |
| WO | 2017096470 | A1 | 6/2017 |

OTHER PUBLICATIONS

Binnemans et al., "Towards zero-waste valorization of rare-earth-containing industrial process residues: a critical review", Journal of Cleaner Production, vol. 99, (Jul. 2015) pp. 17-38.

Liu et al., "Applications and perspective of ionic liquids on rare earths green separation", Separation Science and Technology, vol. 47 (2012) pp. 223-232.

Tan et al., "Rare earth elements recovery from waste fluorescent lamps: a review", Critical Reviews in Environmental Science and Technology, vol. 45, No. 7, (2015) pp. 749-776.

* cited by examiner (1)

(2)

(3)

(4)

(5)

(6)

(7)

(8)

(9)

$CH_3CH_2OSO_3$-

(10)

METHODS OF FORMING METALS USING IONIC LIQUIDS

STATEMENT REGARDING FEDERALLY SPONSORED RESEARCH OR DEVELOPMENT

This invention was made with government support under Contract Number DE-AC07-05-ID14517, awarded by the United States Department of Energy. The government has certain rights in the invention.

FIELD

Embodiments of the present disclosure relate generally to reduction and deposition of metals, such as rare-earth elements.

BACKGROUND

Clean energy deployment depends on a secure source of rare-earth elements (REE). REEs are used in many household and industrial materials. For example, rare-earth elements are used in phosphor powders of fluorescent lighting and light emitting diodes (LEDs), catalysts, magnets, electronic devices including computer memory, DVDs, illuminated screens of electronic devices (e.g., cathode ray tubes, plasma displays, etc.), rechargeable batteries, cellular phones, or other materials.

Rare-earth metals (REMs) may be conventionally produced by electrolysis of salts. REE metal ions are conventionally reduced to the metallic state by using a molten-salt electrochemical process at high temperatures. Anhydrous chlorides of the metal to be produced may be mixed with other salts and melted to yield an electrolyte. A current is passed between electrodes in contact with the electrolyte, and the REM typically is formed at an electrode. This process is energy-intensive and produces considerable quantities of toxic fluoride salt waste. Electrolytic processes for the formation of REEs are described in U.S. Pat. No. 5,190,625, "Electrolytic production of rare earth metals/alloys thereof," issued Mar. 2, 1993.

BRIEF SUMMARY

In some embodiments, a method of forming an elemental metal includes forming a multicomponent solution comprising an ionic liquid, a secondary component, and a metal-containing compound. The multicomponent solution is contacted with at least a first electrode and a second electrode. A current is passed between the first electrode to the second electrode through the multicomponent solution. The metal-containing compound is reduced to deposit metal therefrom on the first electrode.

In certain embodiments, a method of forming an elemental metal includes providing an anode and a cathode in contact with an ionic liquid. The ionic liquid comprises a dissolved species. A metal-containing compound is provided within the ionic liquid. A current passes through the anode and the cathode to reduce the metal-containing compound and deposit a metal therefrom onto the cathode.

In some embodiments, a method for forming solid metal includes continuously passing a current through a cathode, an ionic liquid, and an anode to reduce a metal-containing compound mixed with the ionic liquid and deposit metal therefrom onto the cathode. The ionic liquid comprises a dissolved species in addition to the metal-containing compound.

In some embodiments, a multicomponent solution includes an ionic liquid, a secondary component, and a metal-containing compound.

DETAILED DESCRIPTION

The illustrations presented herein are not actual views of any particular process or system, but are merely idealized representations that are employed to describe example embodiments of the present disclosure. Additionally, elements common between figures may retain the same numerical designation.

Methods of forming rare-earth elements by an electrowinning or electrodeposition process are described herein. For example, such a process may include forming a multicomponent solution of an ionic liquid, a secondary component, and a metal-containing compound. The solution may be placed in contact with electrodes (i.e., an anode and a cathode), and a current may be applied across the solution via the electrodes. The metal-containing compound may be reduced at the cathode to deposit the elemental metal.

Figure 1:
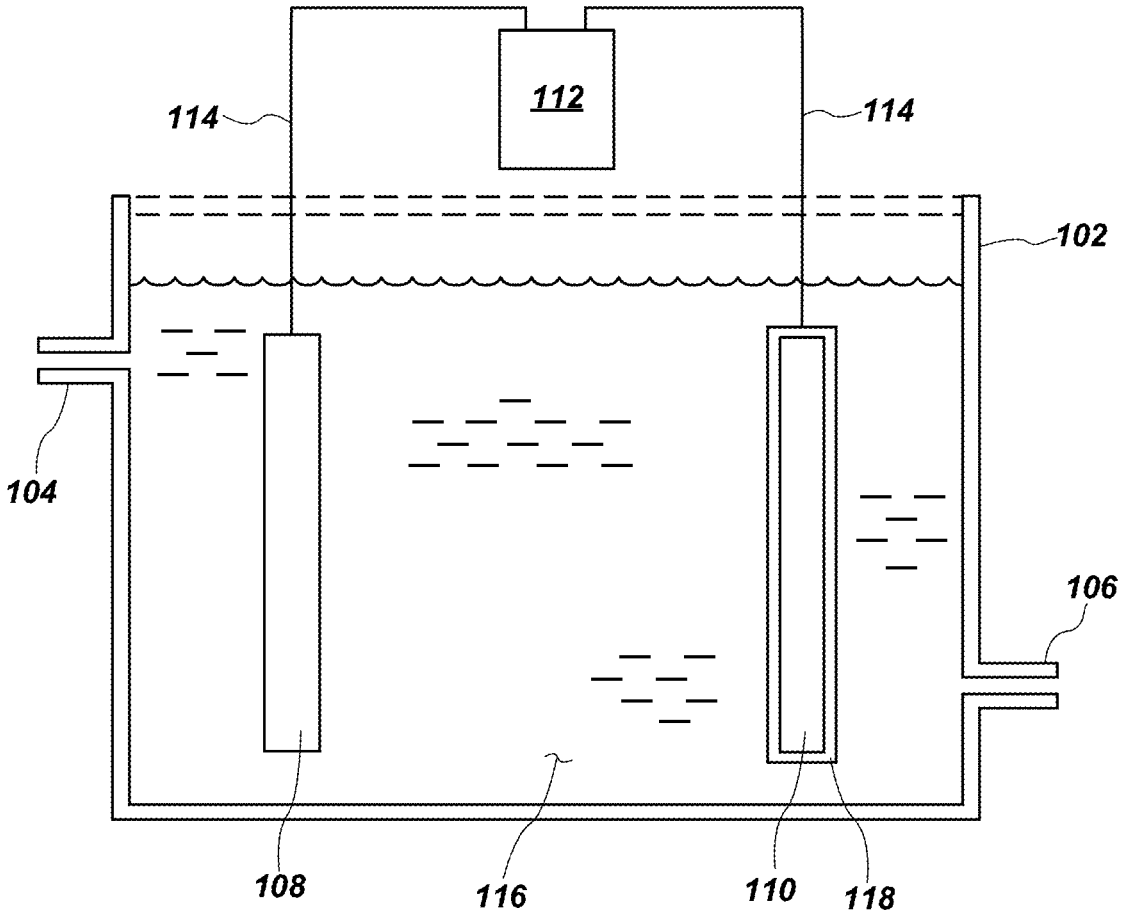
FIG. 1 is a simplified schematic view illustrating a system for forming a metal according to a method of the present disclosure.

FIG. 1 is a simplified schematic view of a system useful for an electrowinning or electrodeposition process. The process may be carried out within a vessel 102, which may include an inlet 104 and an outlet 106. The inlet 104 and outlet 106 may facilitate operation of the process in a continuous-flow manner. The process may also be operated in batch mode and, therefore, the inlet 104 and outlet 106 may be omitted.

An anode 108 and a cathode 110 (also referred to collectively as electrodes 108, 110) may be placed within the vessel 102 and connected to a power source 112 by leads 114. In some embodiments, the vessel 102 may itself act as the anode 108 or the cathode 110, and that electrode may be omitted. In other embodiment, the vessel 102 may be lined with an electrical insulator (e.g., glass, PTFE, etc.) to prevent the vessel 102 from participating in the electrical circuit. The power source 112 may include a battery, a generator, an electrical utility, or any other suitable source of electrical energy. The power source 112 may be configured to provide a direct current to the cathode 110 when an electrical connection between the anode 108 and the cathode exists.

The vessel 102 may contain a multicomponent solution 116 that includes an ionic liquid, a secondary component, and a metal-containing compound. The solution 116 may be a liquid at room temperature and pressure, and may be ionically conductive, such that the solution 116 may operate as an electrolyte, completing an electric circuit that includes the anode 108, the power source 112, and the cathode 110.

Ionic liquids are liquids that are exclusively or almost exclusively ions. Ionic liquids may include at least one cation electrostatically bound to an anion to form a salt that is liquid at a temperature of 20° C. Ionic liquids differ from so-called "molten salts" in that molten salts are typically corrosive and require extremely high temperatures to form a liquid due to ionic bond energies between ions in a salt lattice. For example, the melting temperature of the face-centered cubic crystal sodium chloride is greater than 800° C. In comparison, many ionic liquids are in a liquid phase below 100° C., and may be referred to in the art as room-temperature ionic liquids (RTILs).

Figure 2:
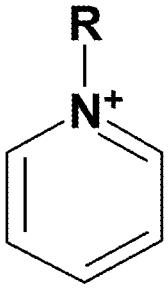
FIG. 2 shows chemical formulas of example cations and anions that may be used in ionic liquids in methods of the present disclosure.
Figure 2:
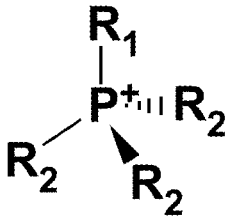
Figure 2:
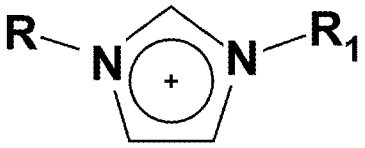
Figure 2:
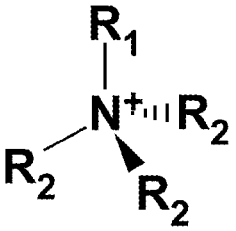
Figure 2:
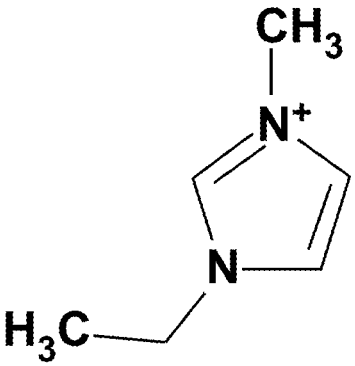
Figure 2:
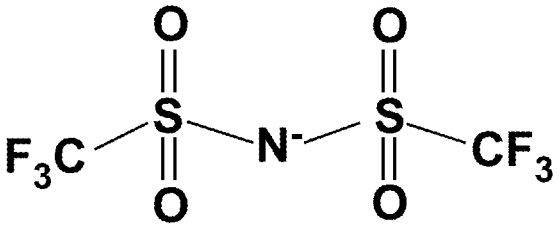
Figure 2:
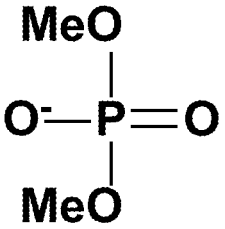
Figure 2:
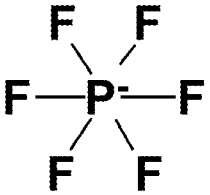
Figure 2:
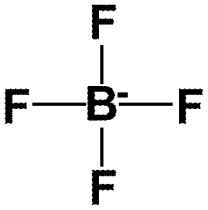

In some embodiments, an ionic liquid may include a cation having any of formulas (1) through (5), shown in FIG. 2, and an anion having any of formulas (6) through (10) of FIG. 2. In the structures shown in FIG. 2, R, $R_1$, and $R_2$, may be hydrogen, hydrocarbon groups (e.g., alkyl groups, cyclcoalkyl groups, alkynyl groups, aryl groups, etc.) or substituted hydrocarbon groups. Some ionic liquids are described in U.S. Pat. No. 6,365,301 "Materials Useful as Electrolytic Solutes," granted on Apr. 2, 2002, the entire disclosure of which is hereby incorporated herein by this reference. In some embodiments, the ionic liquid may include pyrrolidiniums (e.g., N-ethyl-N-methylpyrrolidinium, N-methyl-N-propylpyrrolidinium, N-methyl-N-isopropylpyrrolidinium, N-butyl-N-methylpyrrolidinium, N-isobutyl-N-methylpyrrolidinium, N-secbutyl-N-methylpyrrolidinium, N-methyl-N-pentylpyrrolidinium, N-hexyl-N-methylpyrrolidinium, N-heptyl-N-methylpyrrolidinium, N-methyl-N-octylpyrrolidinium, etc.), piperdiniums, (e.g., N-methyl-N-propylpiperidinium, N-butyl-N-ethyl-piperidinium, N-ethyl-N-octylpiperidinium, etc.), tetra alkyl ammoniums (e.g., N-trimethylbutylammonium, N-hexyltriethylammonium, tetrabutylammonium, trimethyl-N-hexylammonium, dimethylethylphenylammonium, triethylmethylammonium, etc.), phosphoniums (e.g., trihexyl(tetradecyl)phosphonium, tetradecyl(trioctyl)phosphonium, triethyl-pentyl-phosphonium, triethyl-octyl-phosphonium, triethyl-dodecyl-phosphonium, etc.), bis (trifluoromethanesulfonyl)imide, trifluoromethanesulfonate, or dicyanimide, or combinations of any of the foregoing.

The metal-containing compound in the multicomponent solution 116 (FIG. 1) may include a compound containing a rare-earth element (REE), such as Nd, Pr, Eu, Dy, Sm, Ho, Sc, Y, La, Ce, Pm, Gd, Tb, Er, Tm, Yb, or Lu. The REE may be in an oxidized state, and may exhibit a charge of +1, +2, +3, etc. The metal-containing compound may include a metal oxide, a metal nitrate, a metal triflate, a metal carbonate, a metal bistriflimide, a metal-ligand complex, an ionic-liquid-bound metal, a dissolved metal, etc. (wherein the metal may be an REE or any other metal). The metal-containing compound may be dissolved in the ionic liquid. The metal-containing compound may be introduced separately from other components of the multicomponent solution 116 or may be pre-mixed with one or more of the components. In some embodiments, the multicomponent solution 116 may be continuously recycled, and the metal-containing compound may be added to the recycled material. Undesirable byproducts or contaminants may also be removed from the multicomponent solution 116 during such recycle.

The secondary component of the multicomponent solution 116 may be a material selected to increase the solubility of the metal-containing compound in the ionic liquid (i.e., to improve the metal-loading capacity of the ionic liquid to the metal-containing compound). That is, the solubility of the metal-containing compound in a mixture of the secondary component and the ionic liquid may be higher than the solubility of the metal-containing compound in the ionic liquid alone. Thus, by including the secondary component in the multicomponent solution 116, the metal-containing compound may be dissolved in the multicomponent solution 116 at a concentration higher than a solubility limit of the metal-containing compound in the ionic liquid alone or the secondary component alone. Though referred to herein as a secondary component, the amount of the secondary component need not be less than the amount of the ionic liquid.

The secondary component may include, for example, a gas, a liquid, a salt, or a supercritical fluid. In some embodiments, the secondary component may include a second ionic liquid having a different composition than the ionic liquid discussed above. That is, the multicomponent solution 116 may include two or more different ionic liquids, and the metal-containing compound may be dissolved in the mixture of the two ionic liquids.

The secondary component may include any number of conventional solvent-extraction ligands or mixtures of one or more SX ligands (i.e., sulfur-oxide ligands). For example, the multicomponent solution 116 may include ionic liquids that have metal-chelating functions.

Returning to FIG. 1, completion of the electric circuit may cause reduction of the metal-containing compound at the cathode 110 to form a metal therefrom. For example, if the metal-containing compound includes cations of an REE, that REE may be deposited onto the cathode 110. Thus, the process may be used to recover an REE or another metal, such as a transition metal (e.g., Al, Mg, or Li) an actinide, or an alloy or mixture thereof (e.g., Sm—Co, Mg—Fe, Ce—Al), etc. Transfer of electrons may enable reduction of the metal ions in the metal-containing compound to elemental metal (e.g., $M^{3+}+3e^{-}\rightarrow M$). The elemental metal may form a coating 118 or layer on the cathode 110. The coating 118 may be continuously formed, without stopping the deposition process. In some embodiments, the coating 118 may be formed in a plurality of discrete applications. In certain embodiments, the multicomponent solution 116 may include a ligand (e.g., an organophosphorous such as tributylphosphate, tributylphosphine, or tributylphosphite, etc.) to enable the continuous delivery and removal of metal. For example, the ligand may bind to the metal deposited onto the cathode 110 and cause the metal to separate from the cathode 110 (e.g., by falling from the cathode 110) and free up fresh surface area on the cathode 110. The ligand may also remove excess metal and products produced in another redox reaction (if any) that occurs in the multicomponent solution 116.

As the metal is reduced, a corresponding oxidation reaction may occur at the anode 108. If the multicomponent solution 116 contains only the ionic liquid, the secondary component, and the metal-containing compound, one of these components may oxidize at the anode 108. To avoid the oxidation and loss of the ionic liquid or the secondary component, a sacrificial anolyte may be added to the multicomponent solution 116. The anolyte may be formulated to oxidize at the anode 108 more easily than the ionic liquid, the secondary component, or the metal-containing compound, such that these latter three components are left substantially unreacted until the anolyte is consumed. The anolyte may include, for example, formic acid, ammonia, oxalic acid, acetic acid, a low-molecular-weight carboxylic acid, phthalic acid, or any other material that oxidizes at a lower potential than the ionic liquid. In some embodiments, the anolyte may be injected or otherwise provided adjacent the anode 108, such that the anolyte need not diffuse toward the anode 108 to oxidize.

A benefit of using the multicomponent solution 116 as described in an electrowinning process is that reduction and deposition of the metal may be carried out at substantially lower temperatures than conventional electrolysis processes. For example, the metal-containing compound may be reduced at temperatures of less than about 200° C., less than about 120° C., less than about 100° C., or even less than about 50° C. The metal-containing compound may be reduced at room temperature (e.g., about 20° C.) or even lower (e.g., about 0° C.). Operation at such lower temperatures (conventional processes may operate at 800° C. or higher) may simplify processing and significantly lower energy requirements, making embodiments of the disclosed process less costly to perform.

The temperature of the multicomponent solution 116 may influence the viscosity thereof. As known in the art, viscosity (i.e., resistance to flow) generally decreases with increasing temperature. A high viscosity may limit the rate at which the metal-containing compound can be reduced by limiting the flow of the metal-containing compound toward the cathode 110. Thus, in order to make operation at lower temperatures feasible, it may be beneficial to select the ionic liquid, the secondary component, or their concentrations in the multicomponent solution 116 to decrease the viscosity of the multicomponent solution 116. For example, the secondary component may include a supercritical fluid (e.g., carbon dioxide), which may reduce the viscosity of the multicomponent solution 116 and increase the solubility of the metal-containing compound. In some embodiments, the secondary component may include carbon dioxide, nitrogen, argon, hydrogen, helium, propane, butane, nitrous oxide ($N_2O$), hydrofluorocarbons (e.g., difluoromethane (HFC 32), 1,1,1,2-tetrafluoroethane (HFC 134a), trifluoromethane (HFC-23), pentafluoroethane (HFC-125), 1,1,1-trifluoroethane (HFC-143a), 1,1-difluoroethane (HFC-152a), fluoromethane (HFC-41), etc.), ammonia, carbonates (e.g., propylene carbonate, dimethyl carbonate, ethylmethyl carbonate, etc.), ionic liquids (e.g., 1-butyl-3-methylimmidazolium bis(trifluoromethanesulfonyl)imide, 1-ethyl-3-butylimmidazolium bis(trifluoromethanesulfonyl)imide, the ionic liquids listed above, etc.), N,N-dimethylformamide, N,N-dimethylacetamide, etc. The secondary component may include a material that disrupts hydrogen bonding, reduces surface tension, and/or increases shear rate and shear stress, such as surfactants, detergents, emulsifiers, wetting agents, foaming agents, and dispersants. In certain embodiments, the secondary component may be a non-Newtonian shear-thinning liquid such as a liquid polymer or polymer suspension. In further embodiments, the secondary component may include a solid, such as nanoparticles that can form a suspension and that reduce shear stress and viscosity of a fluid. Such solids may or may not dissolve in the fluid. In some embodiments, the secondary component may be an ionic liquid selected to have a relatively low viscosity. In certain embodiments, the secondary component may be a gas, and absorption of the gas into the ionic liquid may lower the viscosity of the ionic liquid. The multicomponent solution 116 may exhibit a viscosity at 20° C. from about 0.1 centipoise (cP) to about 200 cP, such as from about 1 to about 100 cP.

In some embodiments, the secondary component (e.g., carbon dioxide) may be beneficial for more than one purpose, such as to increase the metal-loading capacity of the ionic liquid, to decrease the viscosity of the multicomponent solution 116, and to extract unwanted byproducts from the multicomponent solution 116.

In some embodiments, the multicomponent solution 116 may be maintained under pressure, such as to keep the secondary component in solution. For example, if the secondary component is a gas or a supercritical fluid, the multicomponent solution 116 may be pressurized to limit or prevent escape of the secondary component. In such instances, the vessel 102 may be configured as a closed pressure vessel as shown in broken lines in FIG. 1 but for, in some embodiments, inlet 104 and outlet 106. In some embodiments, the multicomponent solution 116 may be maintained at a pressure from about 1 psig (6.9 kPa) to about 10,000 psig (69 MPa), such as from about 30 psig (207 kPa) to about 50 psig (345 kPa) or from about 100 psig (690 kPa) to about 1,000 psig (6.9 MPa). In other embodiments, the multicomponent solution 116 may be maintained at approximately atmospheric pressure. In embodiments in which the vessel 102 is open to the atmosphere, a protective layer of a material may be disposed over the multicomponent solution 116. For example, the protective layer may include decane, dodecane, mineral oil, or another inorganic hydrocarbon having limited solubility in the multicomponent solution 116. The protective layer may keep oxygen and moisture away from the multicomponent solution 116, such that these materials do not interfere with the reactions or change the viscosity of the multicomponent solution 116.

Another benefit of embodiments of the processes described herein is that such processes may not generate toxic byproducts typical of conventional processes (e.g., CaF or other toxic salts).

The multicomponent solution 116 may be withdrawn from the vessel 102 through the outlet 106 during or after operation of the process. That is, the multicomponent solution 116 or a portion thereof may be separated from the electrodes 108, 110 during or after the metal-containing compound is reduced. In some embodiments, the multicomponent solution 116 may be continuously withdrawn from the vessel 102. The withdrawn portion of the multicomponent solution 116 may be processed to regenerate the ionic liquid. For example, impurities or byproducts generated during the process may be separated from the ionic liquid, such that the ionic liquid may be recycled and reused. The regenerated ionic liquid may be returned to the vessel 102 through the inlet 104, before or after adding other components (e.g., the secondary component, the metal-containing compound, the anolyte, etc.) to form a part of the multicomponent solution 116. Thus, the process may operate in a continuous-flow manner. The secondary component and any remaining portion of the metal-containing compound may also be regenerated. Economics may dictate which component(s) are beneficially regenerated and recycled.

The process may be carried out in an inert atmosphere to protect the multicomponent solution 116 from contamination. For example, oxygen and water may affect the quality of coating 118. The process may therefore be performed in a glove box or under a cover fluid, such as mineral oil, to limit or prevent oxygen and water from diffusing into the multicomponent solution 116.

Current density of the multicomponent solution 116 may be defined as the total current passing through a given cross-sectional area of the multicomponent solution 116 in the vessel 102. In an example embodiment in which the electrodes 108, 110 are parallel plate electrodes, for any plane between the electrodes 108, 110, the current passing through the plane may be constant or may vary with time. However, the electrodes 108, 110 need not be planar; other cell geometries or architectures may be selected. The maximum current density may be a property of the composition and temperature of the multicomponent solution 116. Thus, the composition and temperature of the multicomponent solution 116 may determine the maximum rate at which metal may be reduced and deposited on the cathode 110 in a vessel 102 of a given size. To increase the deposition rate, the current density and/or the area of the cathode 110 may be increased. The secondary component, in particular, may be selected to increase the maximum current density of the multicomponent solution 116. In some embodiments, the multicomponent solution 116 may exhibit a maximum current density at 20° C. of at least about 1 $mA/cm^2$, at least about 2 $mA/cm^2$, or even at least about 5 $mA/cm^2$. For example, the multicomponent solution 116 may exhibit a maximum current density of about 10 $mA/cm^2$. The electrodes 108, 110 may be maintained at a constant voltage by varying the current as conditions change. In other embodiments, the electrodes 108, 110 may pass a constant current by varying the voltage as conditions change.

EXAMPLES

Example 1: Deposition of Neodymium

Figure 3:
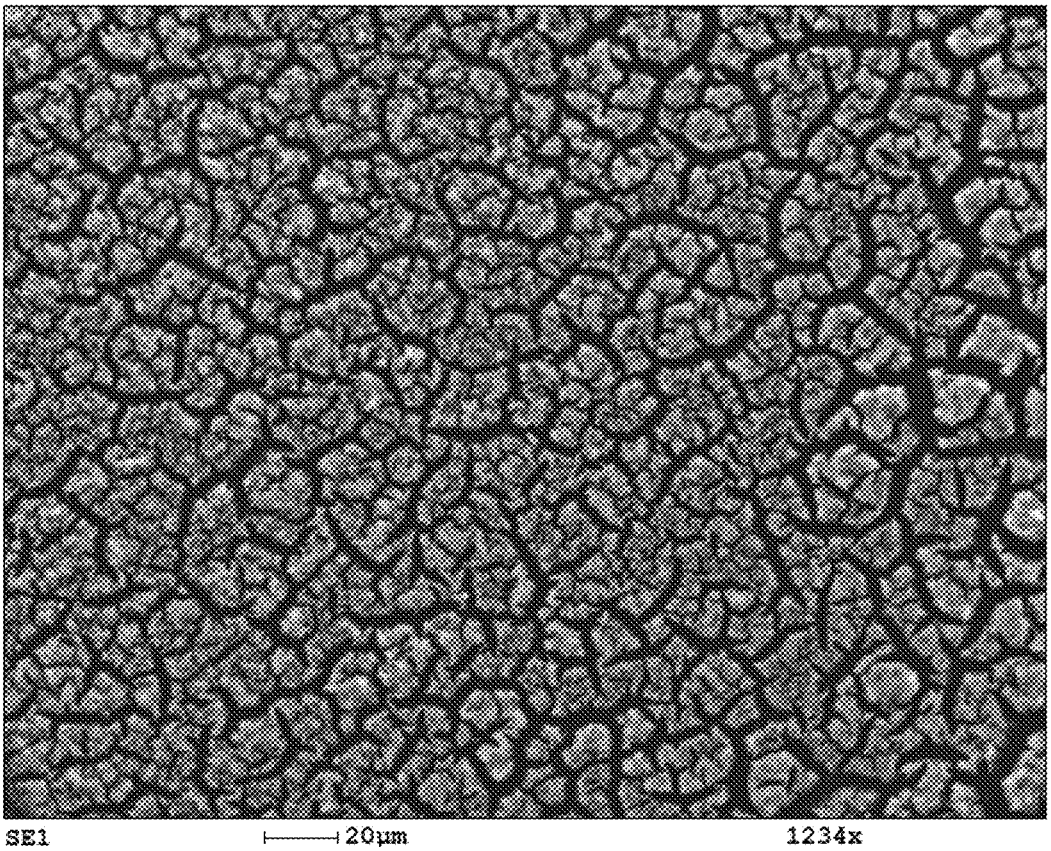
FIG. 3 is an SEM (scan electron microscope) image of an electrode after deposition of neodymium thereon.
Figure 4:
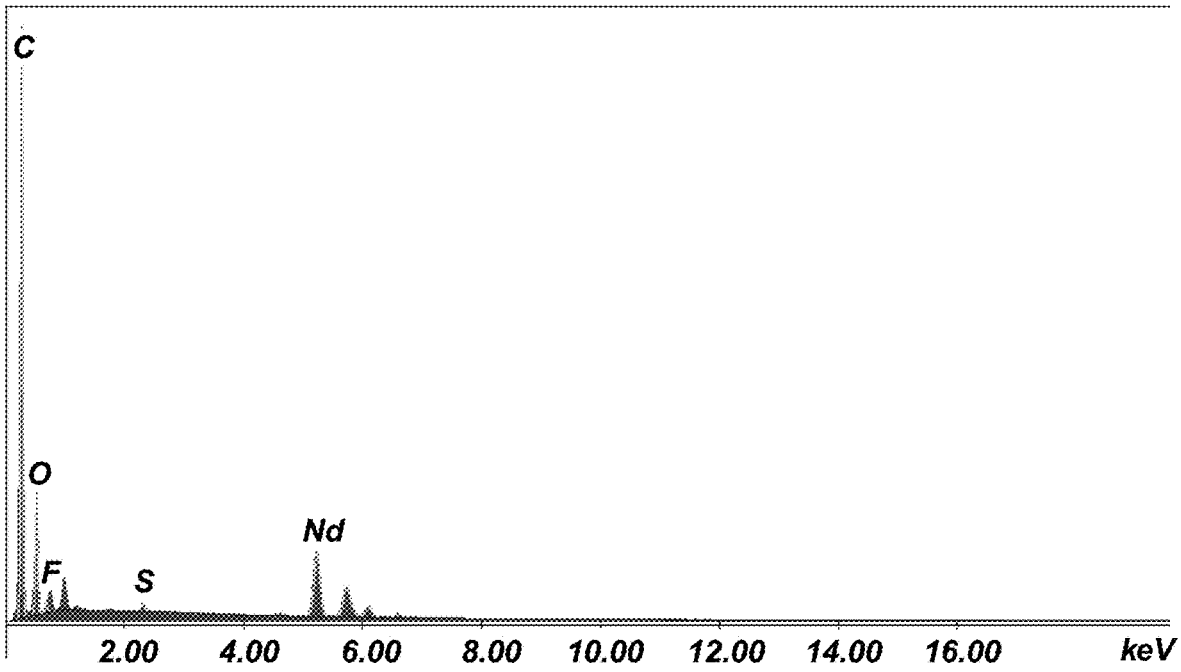
FIG. 4 is a spectrum obtained by energy dispersive X-ray spectrometry (EDS) to analyze the chemical composition of the neodymium shown in FIG. 3.

A neodymium salt was dissolved with N-methyl-N-propylpyrrolidinium bis(trifluoromethylsulfonyl)imide (MPPY Tf2N). The solution was placed in a 10-ml glass beaker and maintained at room temperature of about 20° C. A working electrode, a counter electrode, and a reference electrode were placed in the solution. The electrodes were connected to a potentiostat, (model PC4/750, available from Gamry Instruments, of Warminster, Pa.). The resulting solution was held at a constant potential for a period of time, during which substantially pure elemental metal material was deposited onto the end of the working electrode. The elemental metal material was characterized using scanning electron microscopy-energy dispersive X-ray spectroscopy (SEM-EDS) and determined to contain neodymium. An SEM image of the deposited elemental metal material is shown in FIG. 3, and an EDS spectrum of the metal is shown in FIG. 4. The concentration of the neodymium was verified using inductively coupled plasma mass spectrometry (ICP-MS).

Example 2: Deposition of Praseodymium

Figure 5:
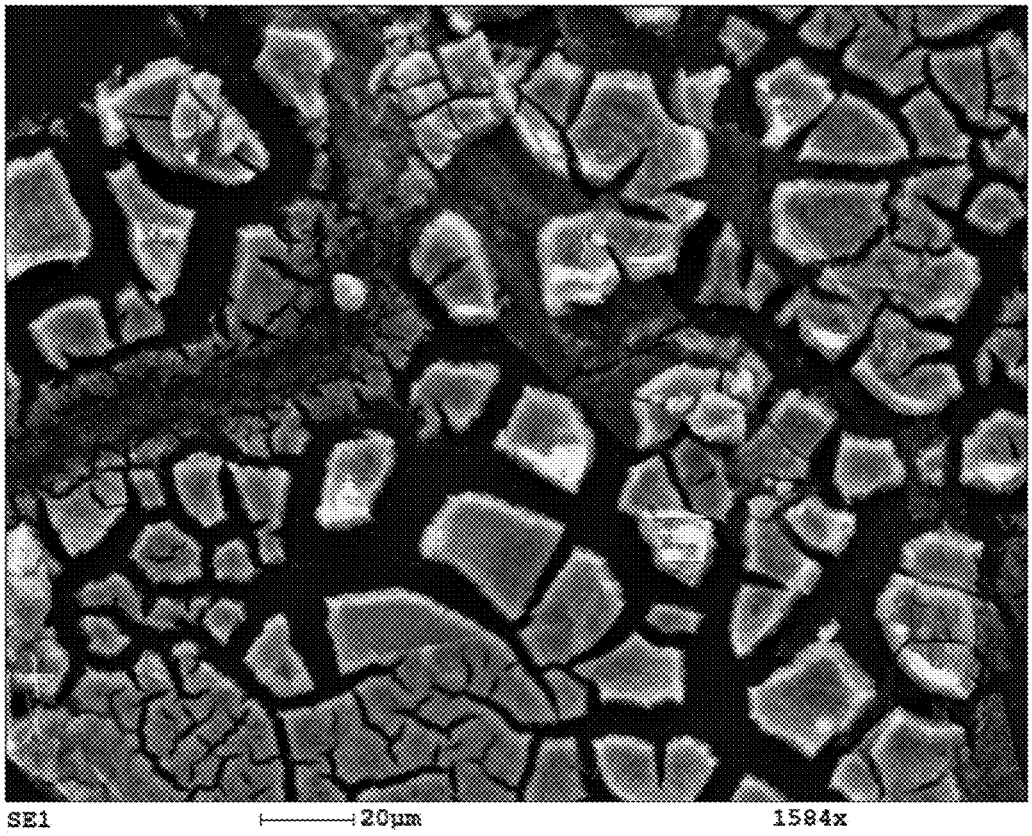
FIG. 5 is an SEM image of an electrode after deposition of praseodymium thereon.
Figure 6:
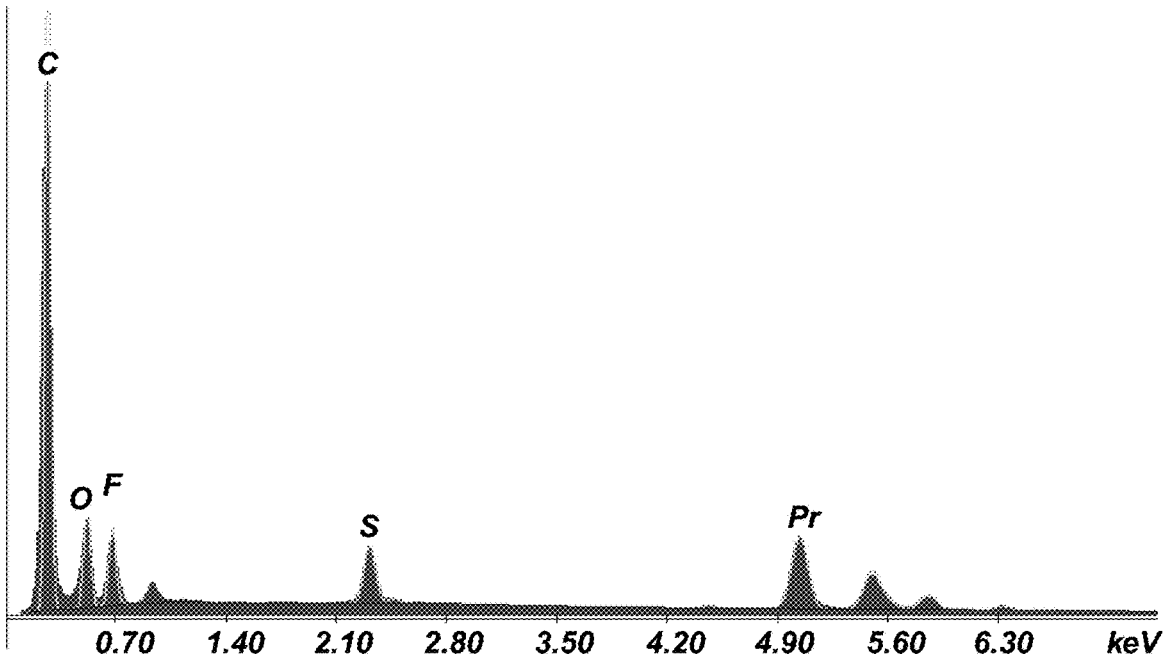
FIG. 6 is a spectrum obtained by EDS to analyze the chemical composition of the praseodymium shown in FIG. 5.

The test described in Example 1 was repeated using a sample of praseodymium salts instead of neodymium salts. An SEM image of the substantially pure deposited elemental metal material is shown in FIG. 5, and an EDS spectrum of the metal is shown in FIG. 6. The concentration of the praseodymium was verified using ICP-MS.

Example 3: Deposition of Europium

Figure 7:
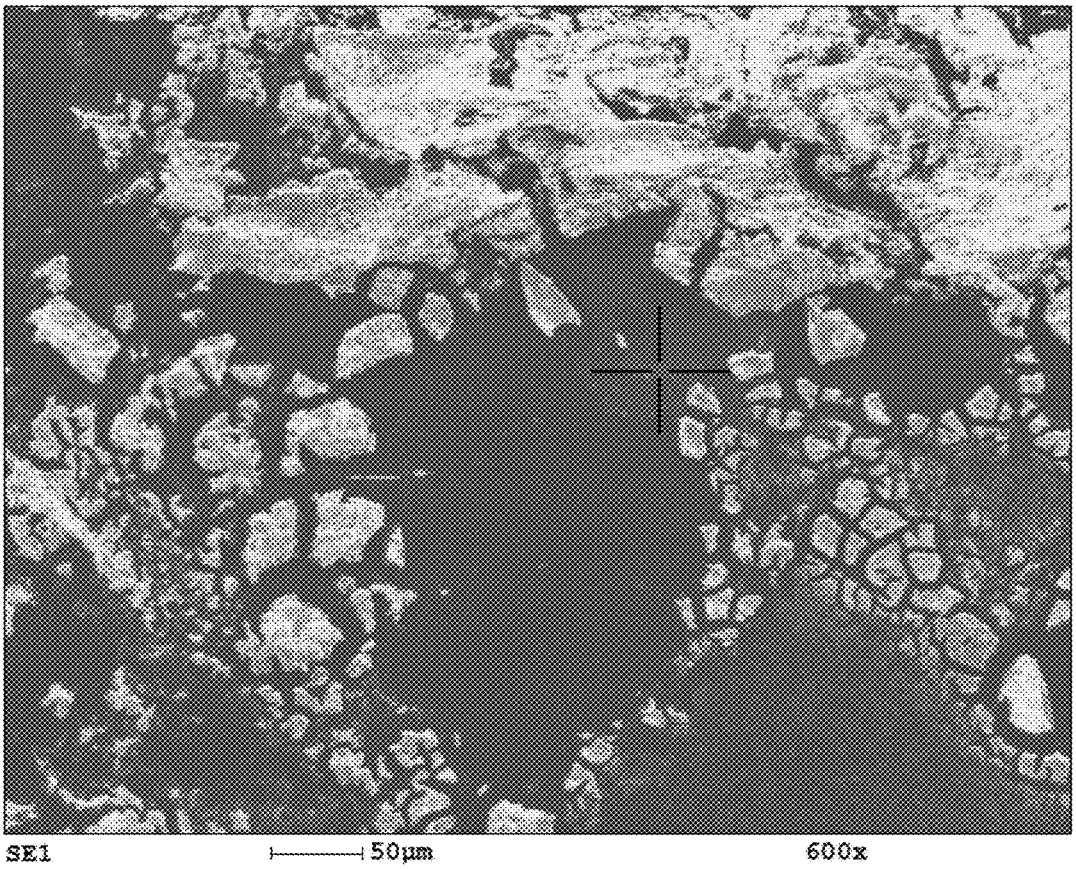
FIG. 7 is an SEM image of an electrode after deposition of europium thereon.
Figure 8:
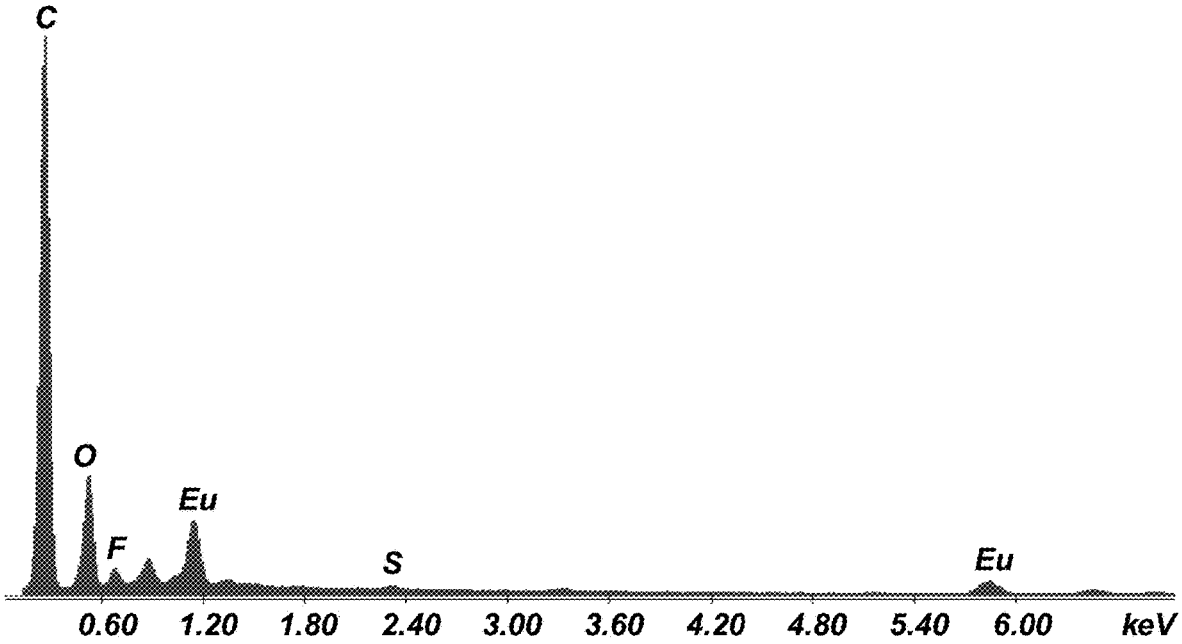
FIG. 8 is a spectrum obtained by EDS to analyze the chemical composition of the europium shown in FIG. 7.

The test described in Example 1 was repeated using a sample of europium salts instead of neodymium salts. An SEM image of the substantially pure deposited elemental metal material is shown in FIG. 7, and an EDS spectrum of the metal is shown in FIG. 8. The concentration of the europium was verified using ICP-MS.

Example 4: Deposition of Dysprosium

Figure 9:
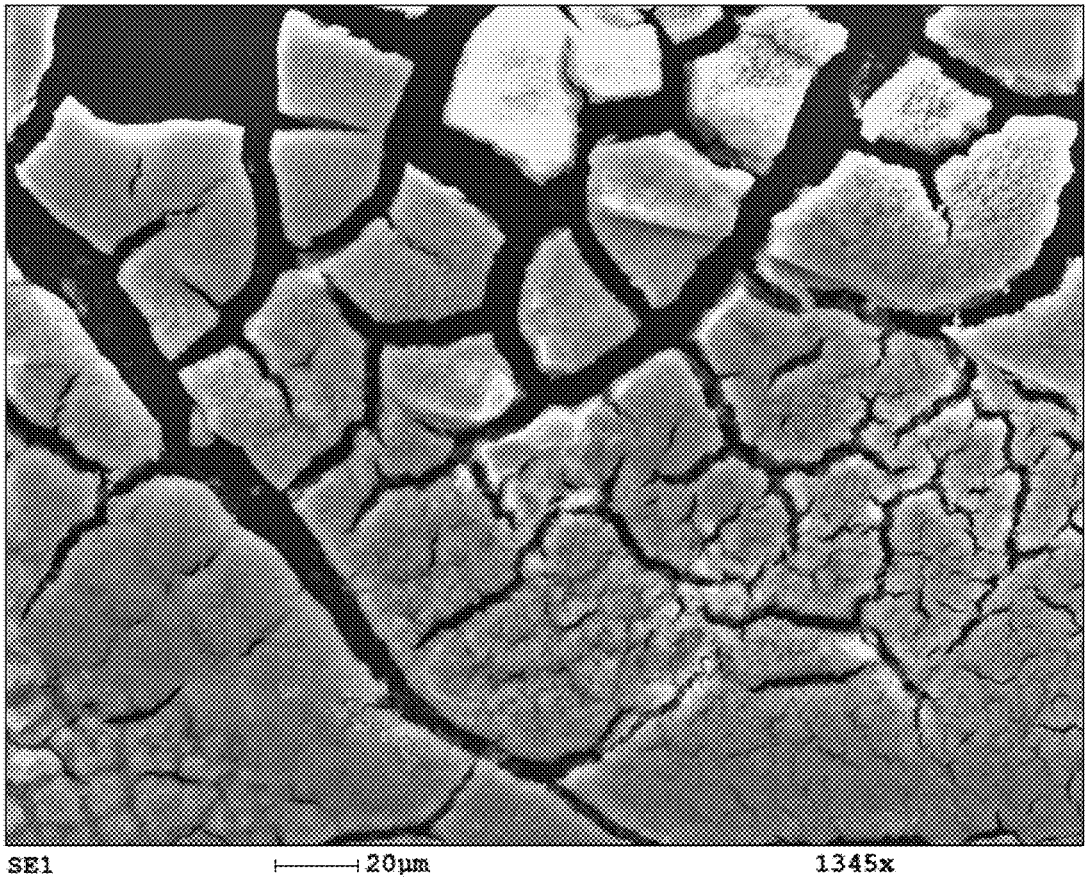
FIG. 9 is an SEM image of an electrode after deposition of dysprosium thereon.
Figure 10:
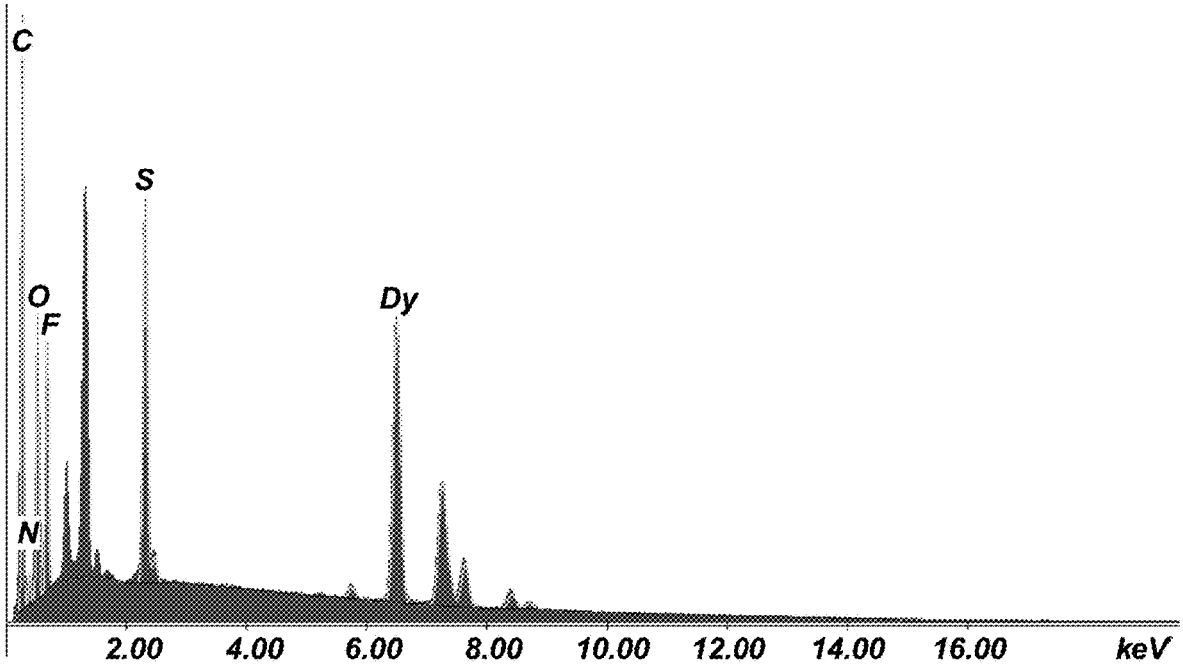
FIG. 10 is a spectrum obtained by EDS to analyze the chemical composition of the dysprosium shown in FIG. 9.

The test described in Example 1 was repeated using a sample of dysprosium salts instead of neodymium salts. An SEM image of the substantially pure deposited elemental metal material is shown in FIG. 9, and an EDS spectrum of the metal is shown in FIG. 10. The concentration of the dysprosium was verified using ICP-MS.

Example 5: Deposition of Samarium

Figure 11:
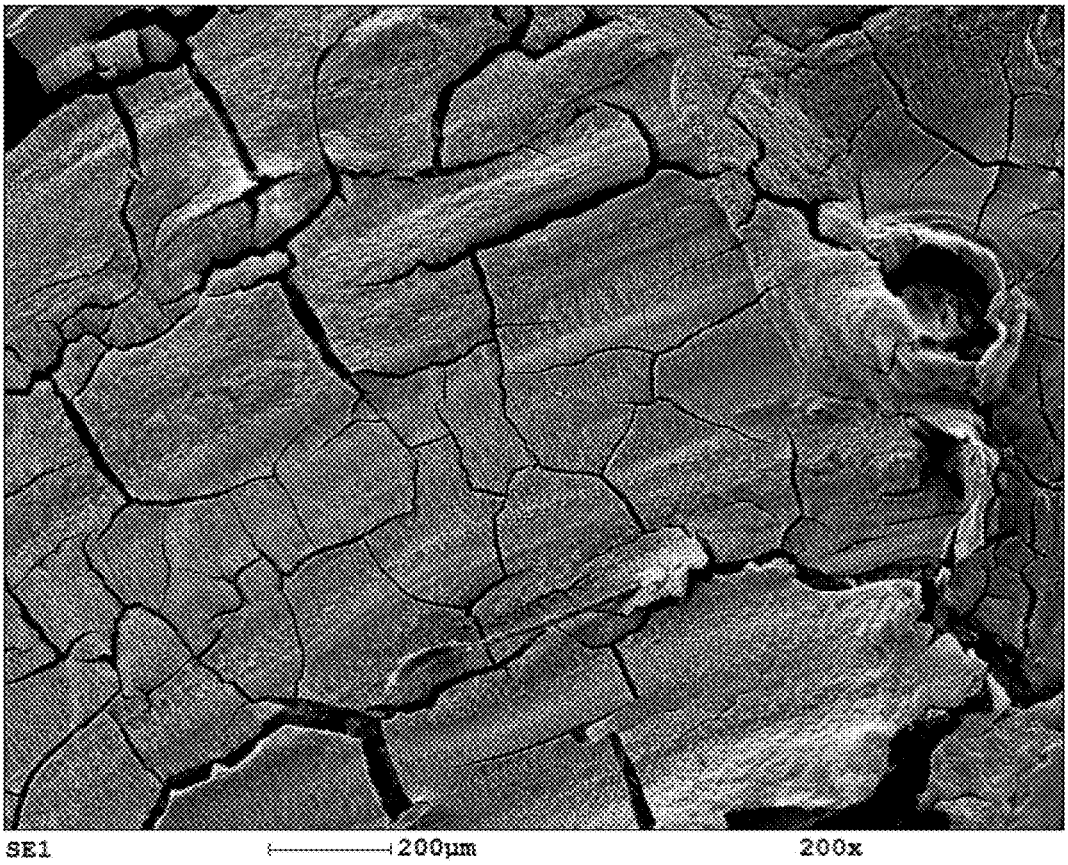
FIG. 11 is an SEM image of an electrode after deposition of samarium thereon.
Figure 12:
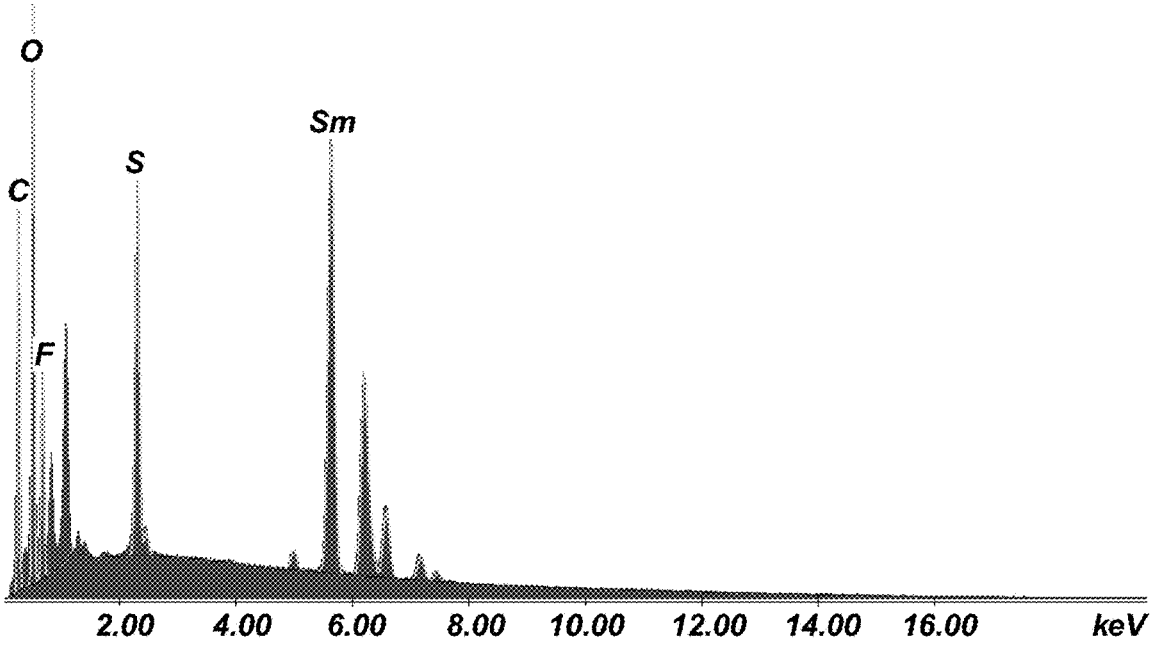
FIG. 12 is a spectrum obtained by EDS to analyze the chemical composition of the samarium shown in FIG. 11.

The test described in Example 1 was repeated using a sample of samarium salts instead of neodymium salts. An SEM image of the substantially pure deposited elemental metal material is shown in FIG. 11, and an EDS spectrum of the metal is shown in FIG. 12. The concentration of the samarium was verified using ICP-MS.

Example 6: Deposition of Holmium

Figure 13:
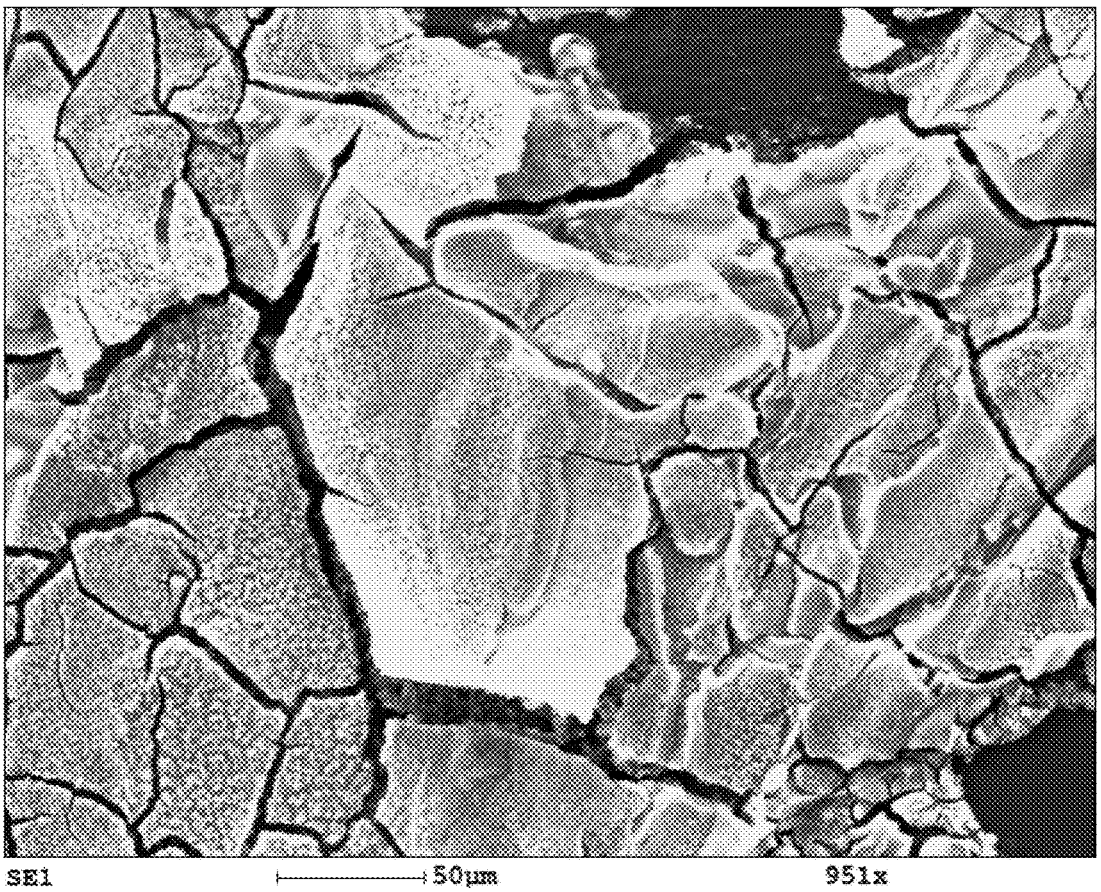
FIG. 13 is an SEM image of an electrode after deposition of holmium thereon.
Figure 14:
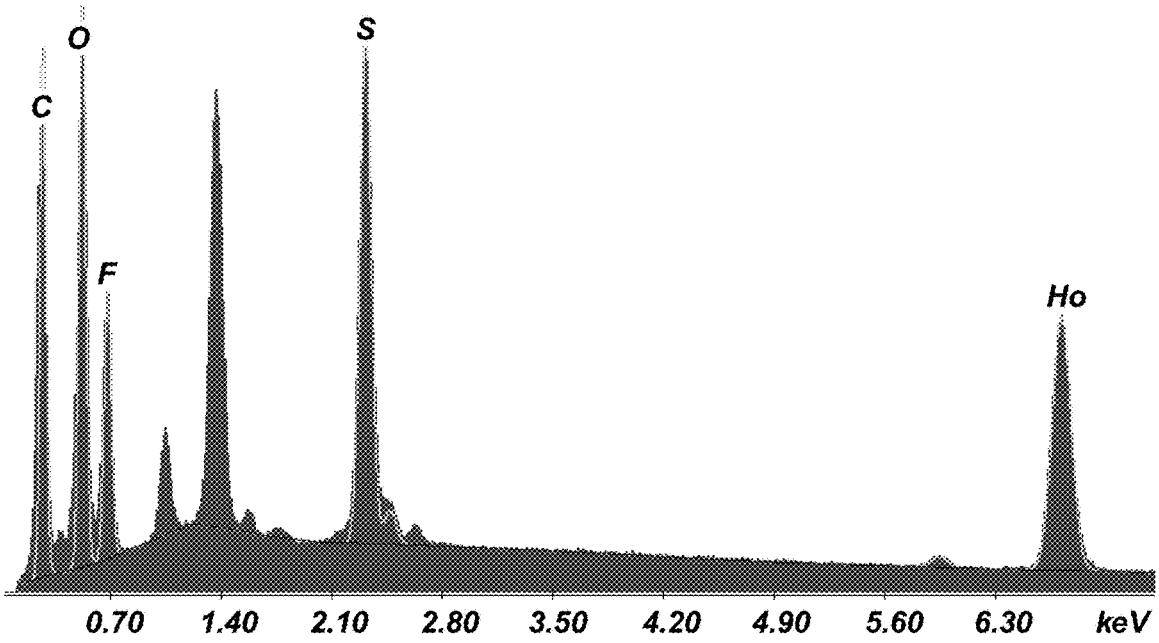
FIG. 14 is a spectrum obtained by EDS to analyze the chemical composition of the holmium shown in FIG. 13.

The test described in Example 1 was repeated using a sample of holmium salts instead of neodymium salts. An SEM image of the substantially pure deposited elemental metal material is shown in FIG. 13, and an EDS spectrum of the metal is shown in FIG. 14. The concentration of the holmium was verified using ICP-MS.

Example 7: Deposition of Samarium in a RTIL Augmented with Propylene Carbonate A sample of samarium salts was dissolved in N-methyl-N-propylpiperidinium bis(trifluoromethylsulfonyl)imide (MPPIP Tf2N) and 25% propylene carbonate. The solution was placed in a 10-ml glass beaker and maintained at room temperature of about 20° C. A working electrode, a counter electrode, and a reference electrode were placed in the solution. The electrodes were connected to a potentiostat, (model PC4/750). The solution was held at a constant potential for a period of time, during which substantially pure elemental metal material was deposited onto the end of the working electrode. The concentration of the samarium was verified using inductively coupled plasma mass spectrometry (ICP-MS).

Prophetic Example 8: Deposition of a REE in a RTIL Augmented with $CO_2$ (Gas, Liquid, or Supercritical Fluid)

A sample of REE salts is dissolved in N-methyl-N-propylpiperidinium bis(trifluoromethylsulfonyl)imide (MPPIPTf2N) and $CO_2$ is introduced. The solution is placed in a polytetrafluoroethylene-lined stainless steel electrochemical pressure vessel and maintained at room temperature of about 20° C. A working electrode, a counter electrode, and a reference electrode are placed in the solution and connected to a potentiostat. The solution is held at a constant potential for a period of time, during which substantially pure elemental metal material is deposited onto the end of the working electrode.

Example 9: Deposition of Holmium in RTILs with or without Formic Acid

Portions of a sample of holmium salts were dissolved in various ionic liquids: N-methyl-N-propylpyrrolidinium bis(trifluoromethylsulfonyl)imide (MPPY Tf2N), N-butyl-N-methylpyrrolidinium bis(trifluoromethylsulfonyl)imide (BMPY Tf2N), and N-hexyl-N-methylpyrrolidinium bis(trifluoromethylsulfonyl)imide (HMPY Tf2N), and in mixtures of these liquids with formic acid. Each solution was placed in a 10-ml glass beaker and maintained at a temperature of about 25° C. A second sample of each solution was placed in a 10-ml glass beaker and maintained at a temperature of about 40° C. A working electrode, a counter electrode, and a reference electrode were placed in each solution. The electrodes were connected to a potentiostat, (model PC4/750). The solution was held at a constant potential for one hour, during which substantially pure elemental holmium was deposited onto the end of the working electrode. The holmium was collected from the electrode and weighed to calculate deposition rates in each solution at each temperature, shown in Table 1 below.

TABLE 1

Deposition rates of holmium

| Ionic liquid or mixture | Deposition rate at 25° C. ($mg/cm^2/hr$) | Deposition rate at 40° C. ($mg/cm^2/hr$) |
|---|---|---|
| MPPY $Tf_2N$ | 0.155 | 0.655 |
| BMPY $Tf_2N$ | 0.06 | 1.0269 |
| HMPY $Tf_2N$ | 0.048 | 1.52575 |
| MPPY $Tf_2N$ with formic acid | 0.5845 | 0.8495 |
| BMPY $Tf_2N$ with formic acid | 0.67285 | 0.89415 |
| HMPY $Tf_2N$ with formic acid | 0.6453 | 0.5937 |

While the present invention has been described herein with respect to certain illustrated embodiments, those of ordinary skill in the art will recognize and appreciate that it is not so limited. Rather, many additions, deletions, and modifications to the illustrated embodiments may be made without departing from the scope of the invention as hereinafter claimed, including legal equivalents thereof. In addition, features from one embodiment may be combined with features of another embodiment while still being encompassed within the scope of the invention as contemplated by the inventors. Further, embodiments of the disclosure have utility with different and various metal-containing compounds.

What is claimed is:

1. A method of recovering an elemental metal, the method comprising:

forming a multicomponent solution comprising an ionic liquid, a secondary component comprising a ligand different from the ionic liquid, and a metal-containing compound, the secondary component selected to increase a solubility of the metal-containing compound in the ionic liquid and decrease a viscosity of the multicomponent solution, a concentration of the metal-containing compound in the multicomponent solution higher than a solubility limit of the metal-containing compound in the ionic liquid alone, the ligand selected from the group consisting of an organophosphorus ligand and a sulfur-oxide ligand;

contacting the multicomponent solution with at least a first electrode and a second electrode;

passing a current between the first electrode and the second electrode through the multicomponent solution; and reducing the metal-containing compound to deposit metal therefrom on the first electrode.

2. The method of claim 1, wherein the secondary component comprises a material selected from the group consisting of a gas, a liquid, a salt, and a supercritical fluid.

3. The method of claim 1, wherein the secondary component further comprises another ionic liquid.

4. The method of claim 1, wherein forming a multicomponent solution comprises forming the multicomponent solution to comprise the ionic liquid, the secondary component, the metal-containing compound, and an anolyte.

5. The method of claim 4, wherein the anolyte comprises a material selected from the group consisting of formic acid, ammonia, oxalic acid, acetic acid, carboxylic acids, and phthalic acid.

6. The method of claim 4, further comprising oxidizing the anolyte at the second electrode.

7. The method of claim 1, wherein forming a multicomponent solution comprises dissolving the metal-containing compound in the ionic liquid.

8. The method of claim 1, wherein the metal-containing compound comprises a compound containing a rare-earth element, and wherein the metal deposited comprises the rare-earth element.

9. The method of claim 1, wherein the metal-containing compound comprises a metal species selected from the group consisting of a metal oxide, a metal nitrate, a metal triflate, a metal carbonate, a metal bistriflimide, a metal-ligand complex, an ionic-liquid-bound metal, and a dissolved metal.

10. The method of claim 1, wherein reducing the metal-containing compound to deposit metal therefrom on the first electrode comprises depositing the metal onto the first electrode at a temperature of less than 200° C.

11. The method of claim 1, wherein reducing the metal-containing compound to deposit metal therefrom on the first electrode comprises depositing the metal onto the first electrode at a temperature between 0° C. and 100° C.

12. The method of claim 1, wherein reducing the metal-containing compound to deposit metal therefrom on the first electrode comprises depositing at least one metal selected from the group consisting of Nd, Pr, Eu, Dy, Sm, Ho, Sc, Y, La, Ce, Pm, Gd, Tb, Er, Tm, Yb, and Lu onto the first electrode.

13. The method of claim 1, further comprising separating the multicomponent solution from the first electrode and the second electrode after reducing the metal-containing compound.

14. The method of claim 13, further comprising regenerating the ionic liquid after separating the multicomponent solution from the first electrode and the second electrode.

15. The method of claim 14, further comprising recycling the regenerated ionic liquid directly to a vessel including the first electrode and the second electrode.

16. The method of claim 1, wherein reducing the metal-containing compound to deposit metal therefrom on the first electrode comprises depositing at least one metal selected from the group consisting of transition metals, actinides, and alloys and mixtures thereof onto the first electrode.

17. A method comprising:

providing an anode and a cathode, each in contact with an ionic liquid;

providing a metal-containing compound within the ionic liquid;

providing a secondary component selected from the group consisting of a gas and a supercritical fluid within the ionic liquid; and passing a current through the anode and the cathode to reduce the metal-containing compound and deposit an elemental metal therefrom onto the cathode.

18. The method of claim 17, wherein providing a secondary component selected from the group consisting of a gas and a supercritical fluid within the ionic liquid comprises dissolving the dissolved metal-containing compound in the secondary component.

19. The method of claim 17, further comprising providing an anolyte in the ionic liquid and oxidizing the anolyte at the anode.

20. The method of claim 17, wherein passing a current through the anode and the cathode comprises depositing the metal onto the cathode at a temperature of less than 200° C.

21. The method of claim 17, wherein passing a current through the anode and the cathode comprises depositing the metal onto the cathode at a temperature between 0° C. and 100° C.

22. The method of claim 17, wherein providing a metal-containing compound within the ionic liquid comprises providing a metal species selected from the group consisting of a metal oxide, a metal nitrate, a metal triflate, a metal carbonate, a metal bistriflimide, a metal-ligand complex, and ionic-liquid-bound metal, and a dissolved metal.

23. A method for recovering an elemental rare earth metal, the method comprising:

continuously passing a current through a cathode, an ionic liquid, and an anode to reduce a rare earth metal-containing compound mixed with the ionic liquid and deposit an elemental rare earth metal therefrom onto the cathode, wherein the ionic liquid is substantially free of oxygen and moisture and comprises a dissolved species in addition to the rare earth metal-containing compound.

24. The method of claim 23, further comprising continuously flowing the ionic liquid through a vessel containing the anode and the cathode.

25. The method of claim 24, further comprising continuously regenerating a portion of the ionic liquid leaving the vessel.

26. The method of claim 25, further comprising recycling the regenerated portion of the ionic liquid to the vessel.

27. The method of claim 23, wherein the dissolved species comprises another ionic liquid.

28. The method of claim 23, wherein the ionic liquid comprises at least one material selected from the group consisting of N-ethyl-N-methylpyrrolidinium, N-methyl-N-propylpyrrolidinium, N-methyl-N-isopropylpyrrolidinium, N-butyl-N-methylpyrrolidinium, N-isobutyl-N-methylpyrrolidinium, N-secbutyl-N-methylpyrrolidinium, N-methyl-N-pentylpyrrolidinium, N-hexyl-N-methylpyrrolidinium, N-heptyl-N-methylpyrrolidinium, N-methyl-N-octylpyrrolidinium, N-methyl-N-propylpiperidinium, N-butyl-N-ethylpiperidinium, N-ethyl-N-octylpiperidinium, N-trimethylbutylammonium, N-hexyltriethylammonium, tetrabutylammonium, trimethyl-N-hexylammonium, dimethylethylphenylammonium, triethylmethylammonium, trihexyl(tetradecyl)phosphonium, tetradecyl(trioctyl)phosphonium, triethyl-pentyl-phosphonium, triethyl-octyl-phosphonium, triethyl-dodecyl-phosphonium, bis(trifluoromethanesulfonyl)imide, trifluoromethanesulfonate, and dicyanimide.

29. The method of claim 23, further comprising mixing the ionic liquid and the rare earth metal-containing compound with a ligand and at least a secondary component.

30. The method of claim 1, wherein forming a multicomponent solution comprising an ionic liquid, a secondary component comprising a ligand, and a metal-containing compound comprises forming a multicomponent solution comprising a secondary component further comprising supercritical carbon dioxide.

* * * * *